United States Patent [19]

Loeb et al.

[11] 4,413,566

[45] Nov. 8, 1983

[54] NON-ABLATIVE PROJECTILE HEAT SENSITIVE NOSE

[75] Inventors: Alfred A. Loeb, Dover; Robert G. Salamon, Boonton, both of N.J.

[73] Assignee: The United States of America as represented by the Secretary of the Army, Washington, D.C.

[21] Appl. No.: 288,827

[22] Filed: Jul. 31, 1981

[51] Int. Cl.[3] ..... F42B 9/20; F42B 11/00

[52] U.S. Cl. ..... 102/517; 102/529

[58] Field of Search ..... 102/529, 444, 498, 501, 102/517, 378; 244/117 A, 158

[56] References Cited

U.S. PATENT DOCUMENTS

| | | | |
|---|---|---|---|
| 2,922,291 | 1/1960 | Fox et al. | 244/117 A X |
| 3,024,941 | 3/1962 | Vandenberg | 244/117 A X |
| 4,140,061 | 2/1979 | Campoli | 102/529 |
| 4,175,492 | 11/1979 | Knappworst et al. | 102/517 X |
| 4,215,632 | 8/1980 | Zaandam | 102/529 |
| 4,242,960 | 1/1981 | Boeder et al. | 102/529 X |
| 4,334,478 | 6/1982 | Goes et al. | 102/529 |

*Primary Examiner*—Harold J. Tudor

*Attorney, Agent, or Firm*—Robert P. Gibson; Anthony T. Lane; Max Yarmovsky

[57] ABSTRACT

A non-ablative heat sensitive nose cap uses a highly conductive solid forward ogive and rear segmented ogive member, in contact with a low melting point locking ring which is thermally isolated from the main projectile body. The locking ring holds the rear ogive segments together until the desired time for projectile-break. Break-up occurs when a zinc alloy locking ring fails under the combined influence of decreasing yield strength and centrifugal force due to launch and free flight imposed spin.

5 Claims, 3 Drawing Figures

NON-ABLATIVE PROJECTILE HEAT SENSITIVE NOSE

GOVERNMENTAL INTEREST

The invention described herein may be manufactured, used and licensed by or for the Government for governmental purposes without the payment to us of any royalty thereon.

BACKGROUND OF THE INVENTION

Various means have been used in the prior art to limit the range of a practice or training projectile. The problem of limiting range in anti-armor training projectiles is particularly troublesome in applications wherein the projectile is required to have a relatively flat trajectory. One method of limiting range of the prior art projectiles was to have the projectile break apart at a predetermined time and/or range. One of the prior art designs utilized an ablative heat sensitive nose which depends upon surface melting for projectile break up. The problem with this design is that currently available heat transfer technology precludes sufficient comparison between experiment and theory to accurately predict design parameters for suitable operation over all normally varying test conditions. Other prior art designs have used electrical and electromechanical timing devices to cause the training round to disintegrate after a projectile has travelled a given distance down range. The problem with these designs is the cost and complexity of building a training round with such range control elements and their lack of reliability when subjected to the high-g forces of hypervelocity spin stabilized saboted projectiles.

PRIOR ART STATEMENT

There is no known pertinent prior art projectile which uses a non-ablative heat sensitive nose cap mechanism to limit the range of a hypervelocity flat trajectory training round by causing break up of the projectile at a predetermined time.

SUMMARY OF THE INVENTION

The present invention relates to a device which provides an anti-armor, fin stabilized, hypervelocity training projectile that will have a limited range in a flat firing trajectory. A non-ablative heat sensitive nose cap uses a highly conductive solid forward ogive and rear segmented ogive member, in contact with a low melting point locking ring which is thermally isolated from the main projectile body. The locking ring holds the rear ogive segments together until the desired time for projectile-break. Break-up occurs when a zinc alloy locking ring fails under the combined influence of decreasing yield strength and centrifugal force due to launch and free flight imposed spin.

An object of the present invention is to provide an anti-armor projectile which will break apart at a predetermined time and/or range.

Another object of the present invention is to provide an anti-armor training projectile with a non-ablative heat sensitive nose means which will maintain outside geometry during hypervelocity flight and break up at a predetermined time or after a given distance.

A further object of the present invention is to provide an anti-armor, hypervelocity, fin stabilized training projectile which has a limited range caused by the break-up of a nose cap assembly under the influence of heat and centrifugal forces.

For a better understanding of the present invention, together with other and further objects thereof, reference is made to the following descriptions taken in connection with the accompanying drawings.

BRIEF DESCRIPTION OF THE DRAWINGS

Throughout the following description like reference numerals are used to denote like parts of the drawings.

DESCRIPTION OF THE PREFERRED EMBODIMENTS

Figure 2:
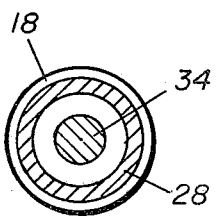
FIG. 2 is a cross-sectional view taken along line 2—2 of FIG. 1.
Figure 1:
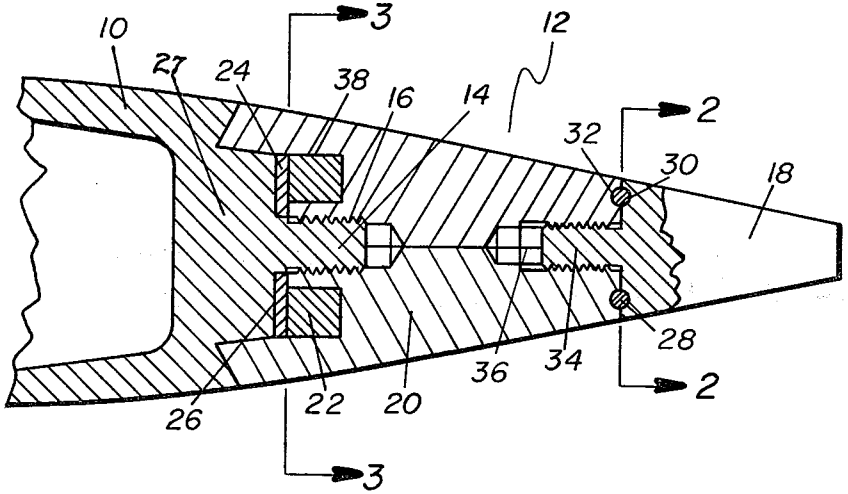
FIG. 1 is a partial cutaway diametral cross-sectional view of the nose cap assembly and projectile.
Figure 3:
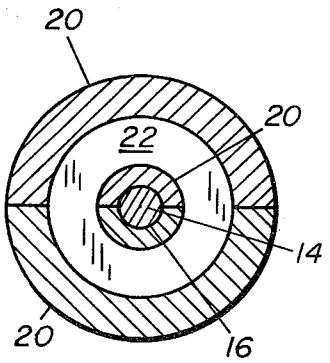
FIG. 3 is a cross-sectional view taken along line 3—3 of FIG. 1.

Referring now to FIGS. 1–3, an anti-armor fin stabilized projectile steel main body forward end 10 is threadedly connected to nose cap assembly 12 by means of an axially aligned threaded projectile screw member 14. Screw member 14 threadedly in gages centrally disposed segment rear threaded cavity 16. The nose assembly 12 comprises three main parts, a copper forward ogive 18, a pair of segmented rear ogive members 20 and a rear locking ring 22. A washer 24 made of thermal insulating material, such as asbestos, is operatively disposed intermediate the front surface 26 of a centrally positioned projectile boss 27 and locking ring 22. Screw member 14 is axially aligned with boss 27 and integrally connected thereto. The rear ogive segments 20 are made of good heat transfer material such as copper and are held together by the rear locking ring 22 which is in turn made of a low melting point material such as zinc alloy. The rear locking ring 22 is thermally insulated from the steel main body 10 by insulator washer 24 to maintain the temperature of the locking ring 22 and to prevent the steel body 10 from acting as a heat sink. In order to prevent premature break-up of the rear ogive segments 20, the conically shaped solid forward ogive 18 member is threadedly attached to the rear ogive segments 20 by means of a forward locking ring 28. Forward locking ring 28 is fixedly held in oppositely positioned semi-annular shaped grooves 30 and 32 disposed in forward ogive 18 and rear ogive 20 respectively by the threaded axially aligned rear end 34 of forward ogive 18. The rear threaded end 34 engages centrally disposed forward threaded cavity 36 of the rear ogive segments 20. The solid forward ogive 18 prevents projectile setback from prematurely opening up the two segment halves of the rear ogive 20.

In operation the zinc alloy locking ring 22 is dimensioned in such a manner as to have a force fit in annular read locking ring groove 38, located in the aft end of the rear ogive segments 20, and to have a compressive radial stress approximately equal to the yield stress of the zinc alloy material. The compressive force of the rear locking ring 22 allows for loading of the nose cap assembly 12 and prevents premature discard of the nose cap assembly 12 from the projectile body 10 during launch. Upon exit of the projectile from the gun muzzle, (not shown) aerodynamic heat transfer occurs over the entire nose cap assembly due to hypersonic flight through the atmosphere. As the temperature of the copper material of the forward and rear ogives 18 and 20 respectively rises due to heat conduction and heat input from the surface, the zinc alloy locking ring 22 increases in temperature to a point at which the centrifugal force from the segmented rear ogive halves 20, due to spin of the projectile body 10, is sufficient to break the rear locking ring 22. The break up occurs due to the yield strength of the zinc alloy locking ring 22 decreasing with increasing temperature. The design of the locking ring 22, insulator 24 and ogive 20 have been selected to allow the rear ogive and the projectile to separate causing break up of the projectile to occur at a specific selected distance down range.

The foregoing disclosure and drawings are merely illustrative of the principles of this invention and are not to be interpreted in a limiting sense. We wish it to be understood that we do not desire to be limited to the exact details of construction shown and described for obvious modifications will occur to a person skilled in the art.

What is claimed is:

1. A heat sensitive nose cap assembly for limiting the range of a fin-stabilized, hypervelocity, anti-armor training projectile which has passed a target which comprises:

a projectile body having a centrally positioned boss located on a front end and an axially alligned screw member integrally connected to said boss;

first thermal conductive means releaseably connected to said screw member of said projectile for maintaining an ogive geometry for said projectile during flight toward said target and for transferring aerodynamically generated heat which includes;

a pair of rear ogive members, having a centrally disposed forward threaded cavity therein, a centrally disposed rear threaded cavity, a semi-annular shaped groove operatively disposed in a front end of said rear ogive members, and a rear locking ring groove positioned in an aft end of said rear ogive members;

second thermal conductive means fixedly connected to said first thermal conductive means for preventing premature break-up of said projectile which includes;

a conically shaped forward ogive member threadedly attached to said rear ogive members, said forward ogive member having a semi-annular shaped groove operationally disposed opposite to the semi-annular grooves of said rear ogive members;

a forward locking ring positioned in said semi-annular grooves of said rear and forward ogive members; and a threaded axially aligned rear end for fixedly engaging the centrally disposed forward threaded cavity of said rear ogive members, said forward ogive preventing the premature opening of said pair of rear ogive members during projectile setback;

a zinc alloy locking ring internally positioned in said projectile and operatively disposed in said rear locking ring groove under compressive radial stress approximately equal to the yield stress of said zinc alloy locking ring, for releaseably holding said first thermal conductive means attached to said projectile body for a specified period of time after launch of said projectile, said first thermal conductive means heating said zinc alloy locking ring and thereby changing the yield strength of said locking ring in response to the aerothermodynamic heating of said rear and forward ogive members, and breaking in response to the centrifugal forces generated by said fin stabilized projectile; and insulator means, operatively disposed intermediate said projectile boss and said zinc alloy locking ring for thermally isolating said zinc alloy locking ring from said projectile boss.

2. A nose cap assembly as recited in claim 1 wherein said first thermal conductive means includes a pair of rear ogive members made of relatively good heat transfer material such as copper.

3. A nose cap assembly as recited in claims 1 wherein said second thermal conductive means includes a forward ogive made of relatively good heat transfer material such as copper.

4. A nose cap assembly as recited in claim 1 wherein said rear locking ring is made of a relatively low melting point zinc alloy material.

5. A nose cap assembly as recited in claim 1 wherein said insulator means includes a washer made of thermally insulating material such as asbestos.

* * * * *